US011510449B2

(12) United States Patent
An

(10) Patent No.: US 11,510,449 B2
(45) Date of Patent: Nov. 29, 2022

(54) CAP HAVING POSITION-VARIABLE VISOR

(71) Applicant: Chan Sol An, Paju-si (KR)

(72) Inventor: Chan Sol An, Paju-si (KR)

( * ) Notice: Subject to any disclaimer, the term of this patent is extended or adjusted under 35 U.S.C. 154(b) by 54 days.

(21) Appl. No.: 16/981,269

(22) PCT Filed: Mar. 13, 2019

(86) PCT No.: PCT/KR2019/002888
§ 371 (c)(1),
(2) Date: Sep. 15, 2020

(87) PCT Pub. No.: WO2019/177359
PCT Pub. Date: Sep. 19, 2019

(65) Prior Publication Data

US 2021/0045484 A1 Feb. 18, 2021

(30) Foreign Application Priority Data

Mar. 15, 2018 (KR) ..... 10-2018-0030383

(51) Int. Cl.
*A42B 1/018* (2021.01)
*A42B 1/0184* (2021.01)
*A42B 1/18* (2006.01)

(52) U.S. Cl.
CPC ..... *A42B 1/0184* (2021.01); *A42B 1/18* (2013.01)

(58) Field of Classification Search
CPC ..... A42B 1/0184; A42B 1/18; A42B 1/203
See application file for complete search history.

(56) References Cited

U.S. PATENT DOCUMENTS 5,471,684 A * 12/1995 Casale ..... A42B 1/0184 2/195.1
5,533,211 A * 7/1996 Mehrens ..... A42B 1/0184 2/195.1

(Continued)

FOREIGN PATENT DOCUMENTS

KR 2019980056034 U 10/1998
KR 1020000037084 A 7/2000

(Continued)

*Primary Examiner* — Khaled Annis
(74) *Attorney, Agent, or Firm* — Renaissance IP Law Group LLP

(57) ABSTRACT

A cap having a position-variable visor according to the present inventive concept is a cap having a visor comprising: a crown having a guide portion provided on the periphery of the lower end thereof; and a sliding portion coupled to the guide portion. The guide portion comprises a guide surface formed to extend toward the outside of the cap, and a guide rail formed by increasing the thickness of the end part of the guide surface. The sliding portion comprises a slider and a slider housing into which the slider is inserted. The slider has a rotating body containing member formed on the slider body and is configured such that a rotating body is inserted into the rotating body containing member so as to rotate freely, and a part of the inserted rotating body is exposed toward the guide rail. In addition, the visor of the cap according to the present inventive concept comprises: a main visor having a sliding portion formed on one end thereof; and an auxiliary visor, one corner portion of which is coupled to the main visor so as to rotate freely, and the other corner portion of which is coupled to the guide portion so as to move freely.

9 Claims, 13 Drawing Sheets

(56) References Cited

U.S. PATENT DOCUMENTS

| | | | | | |
|---|---|---|---|---|---|
| 5,715,534 | A * | 2/1998 | Mobley | A42B 1/0184 | 2/10 |
| 5,870,772 | A * | 2/1999 | Sprouse | A42B 1/0184 | 2/10 |
| 6,263,508 | B1 * | 7/2001 | Davis | A42B 1/0184 | 2/10 |
| 2004/0040067 | A1 * | 3/2004 | Pong | A42B 1/247 | 2/195.2 |
| 2004/0055073 | A1 * | 3/2004 | Ahn | A42B 1/0184 | 2/171 |
| 2004/0244094 | A1 * | 12/2004 | Ahn | A42C 5/00 | 2/175.3 |
| 2006/0143792 | A1 * | 7/2006 | No | A42B 1/0185 | 2/195.2 |
| 2007/0017003 | A1 * | 1/2007 | Harris | A42B 1/0184 | 2/195.1 |
| 2012/0110718 | A1 * | 5/2012 | Kim | A42B 1/0185 | 2/209.12 |
| 2015/0296916 | A1 * | 10/2015 | Olivera, II | A42B 1/0184 | 2/181 |
| 2017/0035134 | A1 * | 2/2017 | Olivera, II | A42B 1/0184 | |
| 2019/0142095 | A1 * | 5/2019 | Judge | A42B 1/0184 | 2/195.1 |
| 2021/0145102 | A1 * | 5/2021 | Tang | A42B 1/0184 | |

FOREIGN PATENT DOCUMENTS

| | | | |
|---|---|---|---|
| KR | 200213373 | Y1 | 2/2001 |
| KR | 200243049 | Y1 | 10/2001 |
| KR | 200390299 | Y1 | 7/2005 |
| KR | 2020120000242 | U | 1/2012 |

* cited by examiner

CAP HAVING POSITION-VARIABLE VISOR

TECHNICAL FIELD

The present disclosure relates to a cap including a rotatable visor, and more particularly, to a cap in which a visor smoothly rotates when a position of the visor is laterally changed.

BACKGROUND ART

Generally, a cap includes a crown which is a cover surrounding a head and a sun-screening visor sewn into a bottom part of the crown.

Also, caps are generally used to prevent a face from being exposed to sunlight during outdoor activities or exercises. A user who wears a cap generally shades his or her face from sunlight using a method of changing a direction of a visor by adjusting the cap when a direction of sunlight changes.

However, since it is very inconvenient to continuously adjust the cap according to the direction of sunlight, many visor-rotatable caps have been provided to shade the user from sunlight by only turning a visor left or rightward without adjusting the cap. Such conventional techniques have been disclosed in Korean Utility Model Registration No. 0390299, Korean Patent Publication No. 2000-0037084, and the like.

Caps disclosed by the conventional techniques are configured so that connection portions of a crown and a visor are formed as a sliding protrusion and a sliding groove, respectively, so that the crown and the visor are relatively rotatable along the connection portions. However, since the sliding protrusion and the sliding groove come into direct contact with each other, when the visor is rotated, frictional resistance occurs and rotation is not smoothly performed.

Meanwhile, a head circumference of human is not a completely circular shape and is generally an elliptical shape having a long length from a forehead to an occipital region and a short length between temporal regions. That is, curvatures of the circumference at the forehead, the temporal regions, and the occipital region differ from one another.

Accordingly, when caps of the above conventional techniques are worn, a bottom edge of a crown thereof changes to an elliptical shape according to a head shape such that rotation is not smoothly performed at parts at which curvatures among a forehead, temporal regions, and an occipital region are changed when a visor is rotated.

DISCLOSURE

Technical Problem

The present inventive concept is directed to providing a coupling portion structure that enables relative rotation between a visor and a crown, which is improved to minimize frictional resistance when the visor rotates.

The present inventive concept is also directed to providing a visor structure that enables a visor to smoothly rotate regardless of a head shape of a person wearing a cap.

Technical Solution

One aspect of the present inventive concept provides a cap with a position-variable visor. The cap includes a crown including a guiding portion on an edge of a bottom end and a visor including a sliding portion coupled to the guiding portion.

The guiding portion may include a guiding surface formed to extend outward from the cap and a guiding rail formed by increasing a thickness of an end of the guiding surface, and the sliding portion may include a slider and a slider housing into which the slider is inserted.

In the slider, a rotating body accommodation hole may be formed in a slider body and a rotating body may be inserted into the rotating body accommodation hole to be freely rotatable while a part of the inserted rotating body is exposed toward the guiding rail.

The slider housing may be divided into an upper housing body and a lower housing body with a path therebetween through which the guiding surface and the guiding rail pass laterally.

The upper housing body may be located above the path and may include an upper separation-preventing step by which an upper part of the guiding rail is held, and the lower housing body may be located below the path and may include a slider accommodation portion into which the slider is inserted.

A leaf spring accommodation portion may be formed in the slider body below the rotating body accommodation hole.

The leaf spring accommodation portion may accommodate a leaf-spring portion. An elastic piece including a rotating body mounting portion may be formed on the leaf-spring portion. Also, a lower part of the rotating body inserted in the rotating body accommodation hole may be configured to be mounted in the rotating body mounting portion.

A protruding step may be formed on a top surface of the slider body so that the guiding rail is held by the protruding step not to be separated therefrom, and the lower housing body located below the path may include a lower separation-preventing step by which a lower part of the guiding rail is held.

A coupling protruding portion protruding outward may be formed on an outer surface of the slider body. A slider coupling groove may be formed in an inner sidewall of the slider housing. Also, the coupling protruding portion may be inserted into the slider coupling groove so that the slider is coupled to the slider housing.

The visor of the cap with the position-variable visor may include a main visor having one end on which the sliding portion is formed and an auxiliary visor having one corner part coupled to the main visor to be freely rotatable and another corner part coupled to the guiding portion to be freely movable.

The auxiliary visor may be formed by vertically coupling an upper auxiliary visor located on a top surface of the main visor to a lower auxiliary visor located on a bottom surface of the main visor, and an insertion gap into which a part of the main visor is inserted may be formed between the upper auxiliary visor and the lower auxiliary visor which are coupled to each other.

The main visor may include a coupling hole formed therein. The auxiliary visor may include a fastening hole formed in any one of the upper auxiliary visor and the lower auxiliary visor and a fastening protrusion formed in another one of the upper auxiliary visor and the lower auxiliary visor at a position corresponding to the fastening hole. Also, the fastening protrusion may pass through the coupling hole of the main visor inserted into the insertion gap and may be fastened to the fastening hole so as to couple the auxiliary visor and the main visor.

The main visor may include a guiding hole having an elongated hole shape and configured to guide the auxiliary visor not to be separated from a course when the auxiliary visor moves relatively to the main visor, and the auxiliary visor may include an intermediate guiding protrusion inserted into the guiding hole to be formed inside the insertion gap.

The guiding portion may include a guiding surface formed to extend outward from the cap and a guiding rail formed by increasing a thickness of an end of the guiding surface, and the guiding portion and the auxiliary visor may be coupled by the guiding rail of the guiding portion being inserted into and then held by a guiding protrusion portion of the auxiliary visor.

Advantageous Effects

Since rolling movement occurs, due to a rotating body, between a guiding portion of a crown and a sliding portion of a visor coupled to the guiding portion and rotated, frictional resistance is reduced so that rotation of the visor may be smoothly performed.

Also, according to the present inventive concept, since the sliding portion is formed by assembling a slider as a separate component to be inserted into and coupled to a slider housing, an unskilled worker may easily and quickly manufacture a product.

According to the present inventive concept, when the visor is rotated while a cap is worn, an auxiliary visor and a main visor relatively move so that rotation of the visor may be smoothly performed according to a change in curvature of a head circumference.

DETAILED DESCRIPTION

Figure 1:
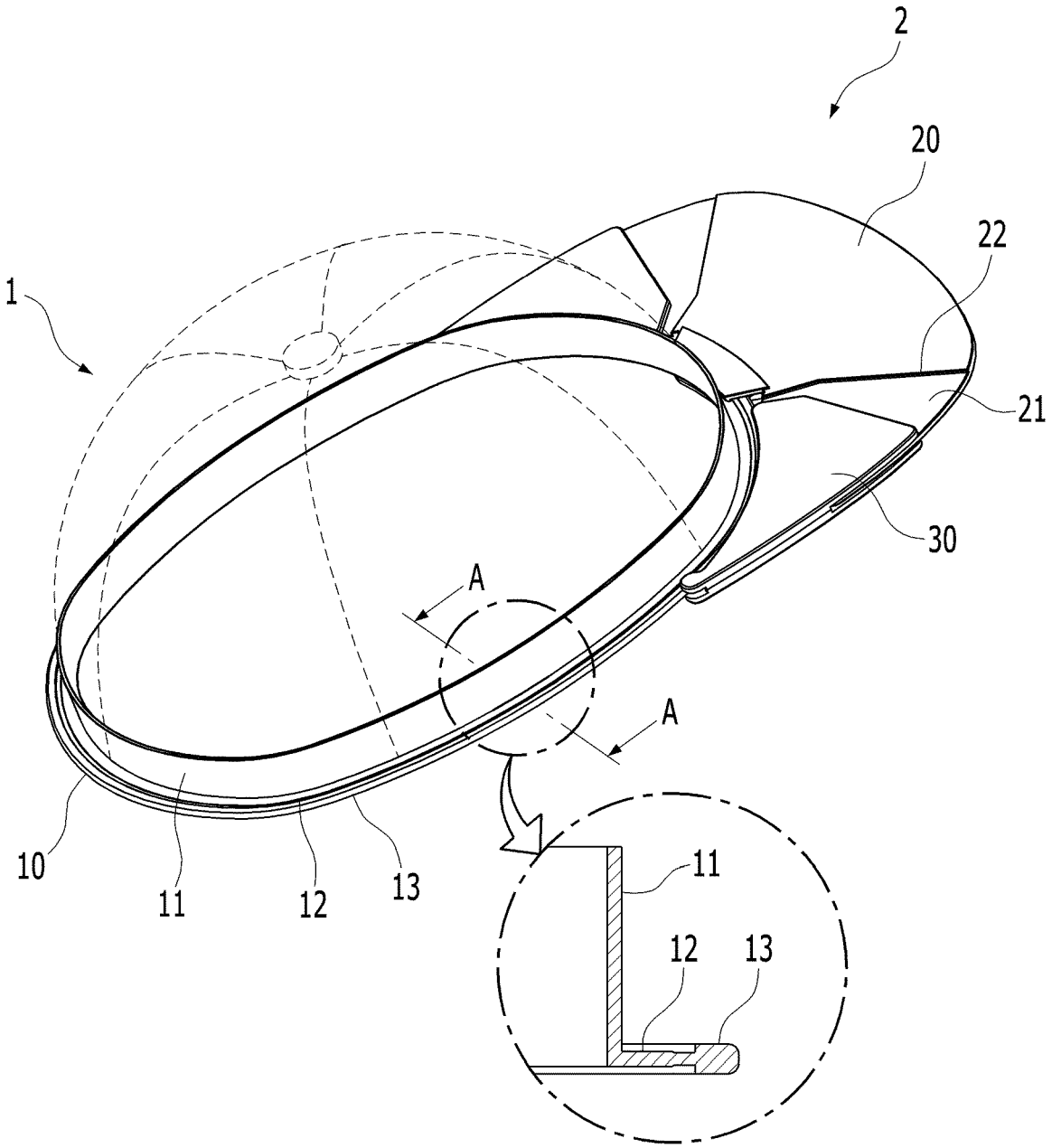
FIG. 1 is an upper perspective view of the present inventive concept.

Hereinafter, embodiments of the present inventive concept will be described in detail with reference to the attached drawings. However, thicknesses of lines, sizes of components, and the like shown in the drawings may be exaggerated or reduced for convenience to allow a configuration of the present inventive concept to be more clearly understood.

Among the terms used for description of the present inventive concept, there are terms defined in consideration of functions thereof. However, since these terms may be expressed as different terms depending on an intention of a user or custom, they should be reasonably understood by considering content disclosed throughout the specification.

Also, directional terms such as "above," "below," "front," "rear," "left," "right," "front end,", "frontward," "rear end," "rearward," and the like are generally based on orientation in the drawing(s). However, since components of the embodiments of the present inventive concept may be set in position in a variety of orientations, the directional terms are used for example but do not limit the positions.

When it is disclosed that the components used herein are "connected," "coupled," "fastened," or the like to each other, it should be understood that the components may be "connected," "coupled," "fastened," or the like in an indirect method using an intermediate medium element.

Also, in the description of the present inventive concept, a detailed description of well-known functions and components which may be deemed to unnecessarily obscure the essential of the present inventive concept will be omitted.

Figure 2:
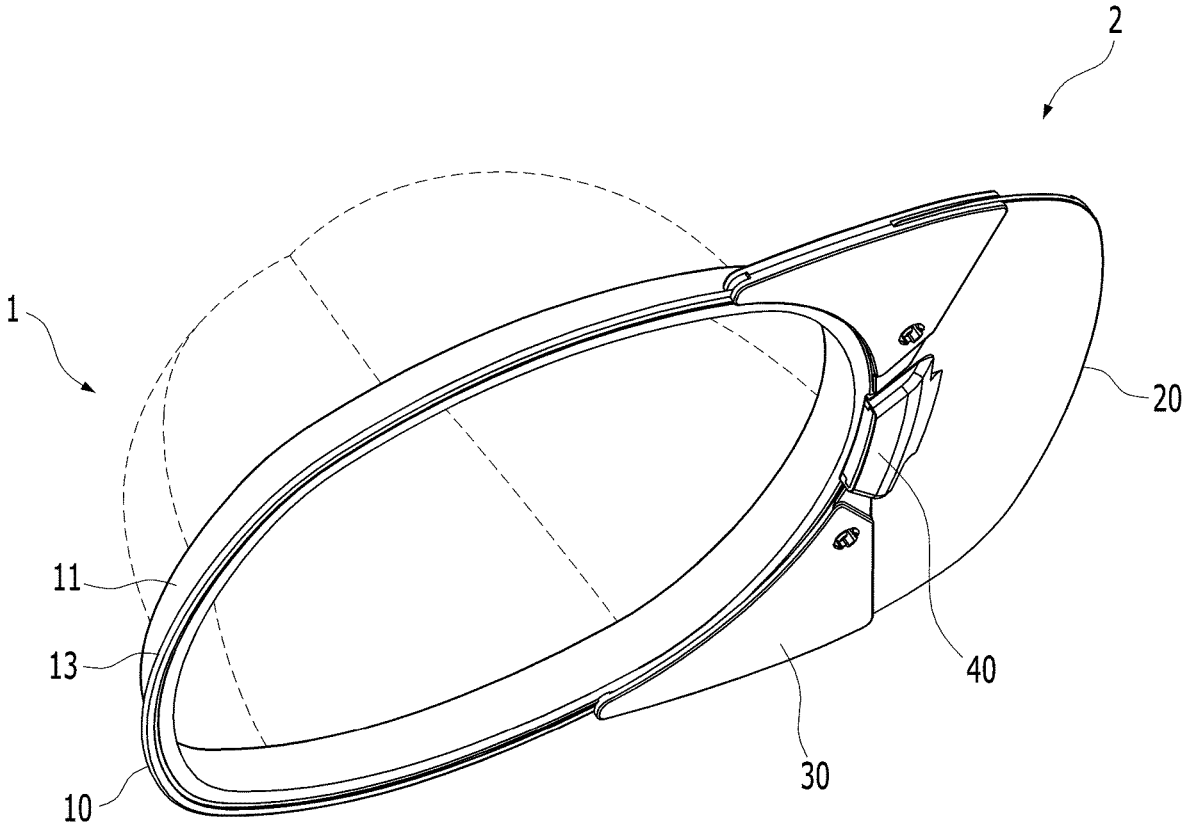
FIG. 2 is a lower perspective view of the present inventive concept.
Figure 3:
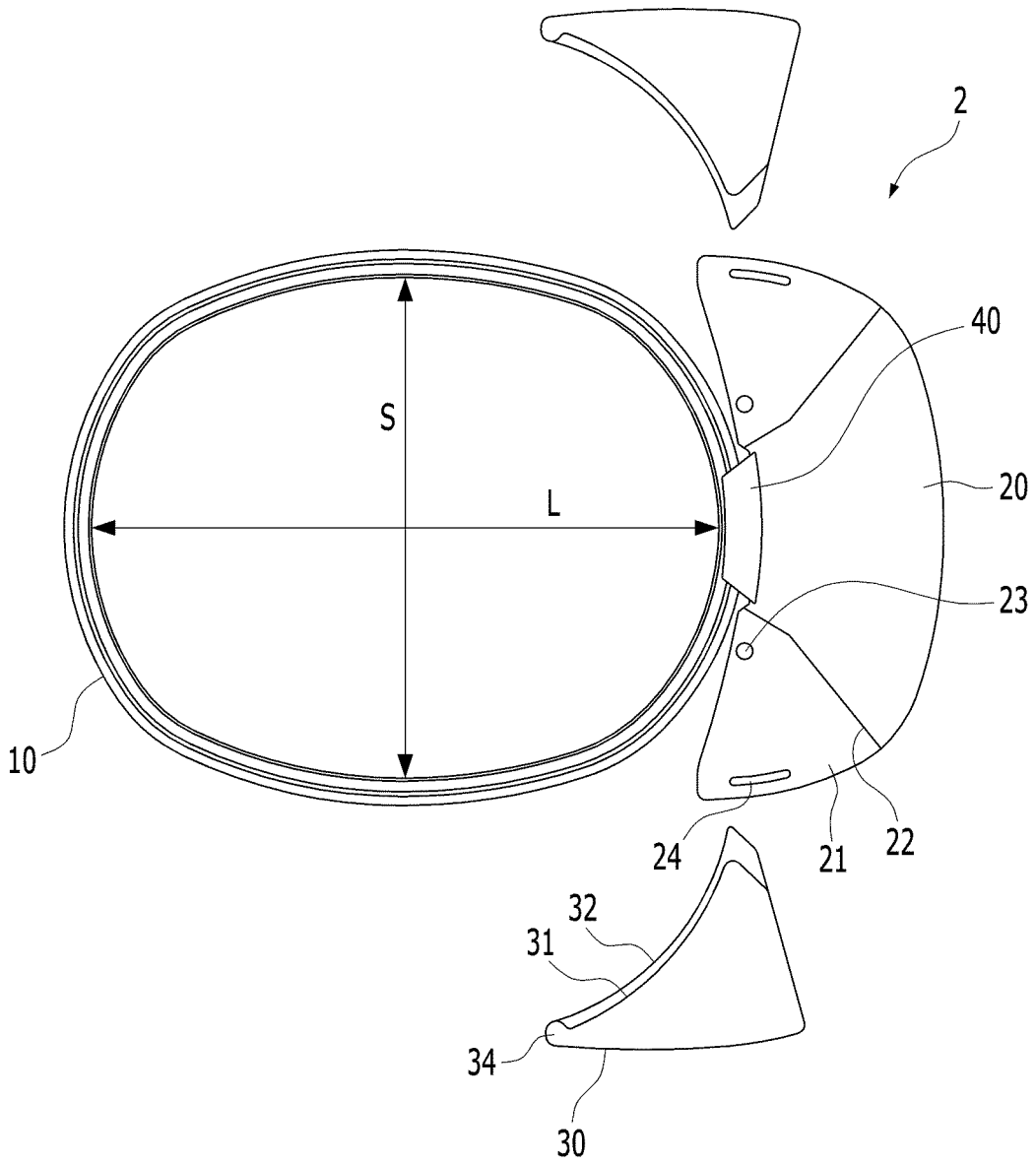
FIG. 3 is an exploded view illustrating a main part of the present inventive concept when viewed from above.

An exterior which allows the whole components of the present inventive concept to be recognizable is shown in FIGS. 1 to 3. Components for relatively rotating a visor and a crown of a cap in order to vary a position of the visor are shown in FIGS. 4 to 7. Components for smoothly rotating the visor regardless of a curvature of a head circumference of a person who wears the cap are shown in FIGS. 3 and 8 to 13.

Hereinafter, significant components and functions capable of varying relative positions of a visor and a crown of a cap according to an embodiment of the present inventive concept will be described first with reference to FIGS. 1 to 3.

FIGS. 1 and 2 illustrate the cap of the present inventive concept in perspective when viewed from above and below, respectively. FIG. 3 is an exploded view in which a main visor 20 and auxiliary visors 30 according to the present inventive concept are separated.

As shown in FIGS. 1 to 3, the cap according to the present inventive concept includes a crown 1 including a head cover (part shown as a dotted line) and a guiding portion 10 installed on an edge of a bottom end of the head cover and includes a visor 2 formed by combining the main visor 20 and the auxiliary visors 30.

Accordingly, in the cap of the present inventive concept, the guiding portion 10 pressed against the head circumference is formed to have an elliptical shape in which a front-rear length L of the head is longer than a lateral width S thereof. The guiding portion 10 may be manufactured using a material such as a synthetic resin or the like having an elastic force so as to be deformable according to a head shape of a person who wears the cap. Although a human head generally has a front-rear length greater than a lateral width, there are differences between human races and persons.

FIG. 1 is an enlarged cross-sectional view illustrating the guiding portion 10 taken along line A-A.

The guiding portion 10 in the enlarged cross-sectional view is divided into a supporting edge 11 configured to surround the head circumference, a guiding surface 12 formed to extend outward from a bottom end of the supporting edge 11, and a guiding rail 13 formed by increasing a thickness of an end of the extending guiding surface 12 more than a thickness of the guiding surface. Here, sectional shapes of the guiding surface 12 and the guiding rail 13 are similar to that of a rail of railroad.

The supporting edge 11 is formed to have a band shape having a long length and a width of about 10 mm. The guiding surface 12 which extends laterally in an outward direction is formed on the bottom end of the supporting edge 11, and the head cover shown as the dotted line is attached to an upper part by sewing, bonding, or the like.

The guiding surface 12 is a surface where a rotating body 50 of a sliding portion 40, which will be described below, comes into contact therewith and rolls thereon.

In the embodiment of the present inventive concept, the guiding surface 12 is formed along a whole perimeter of the supporting edge 11 but may be formed on a part of the supporting edge 11 as necessary. A width of the guiding surface 12 may be formed to be about 5 mm.

The guiding rail 13 formed on the end of the guiding surface 12 functions so that the main visor 20 which will be described below is coupled to the sliding portion 40 and a guiding protrusion portion 34 of the auxiliary visor 30 to be freely movable so as to allow the visor 30 to be stably movable without being separated while rotating along the guiding portion 10.

In the embodiment of the present inventive concept, as shown in the enlarged cross-sectional view taken along line A-A of FIG. 1, the guiding rail 13 has a shape formed by vertically increasing a thickness of the guiding surface 12 at an end of the guiding surface. When necessary, the guiding rail 13 may be formed by increasing the thickness of the guiding surface 12 in only one of upward and downward directions. A width of the guiding rail 12 may be formed to be about 2 mm.

As shown in FIG. 2, the sliding portion 40 is formed at a rear end of the visor 2, that is, an end thereof toward the crown 1. The guiding rail 13 is coupled to and laterally passes through the sliding portion 40, and the visor 2 may be laterally movable along the guiding rail 13 using the sliding portion 40.

Subsequently, components of the sliding portion 40 according to the embodiment of the present inventive concept will be described in detail with reference to FIGS. 4 to 7.

Figure 4:
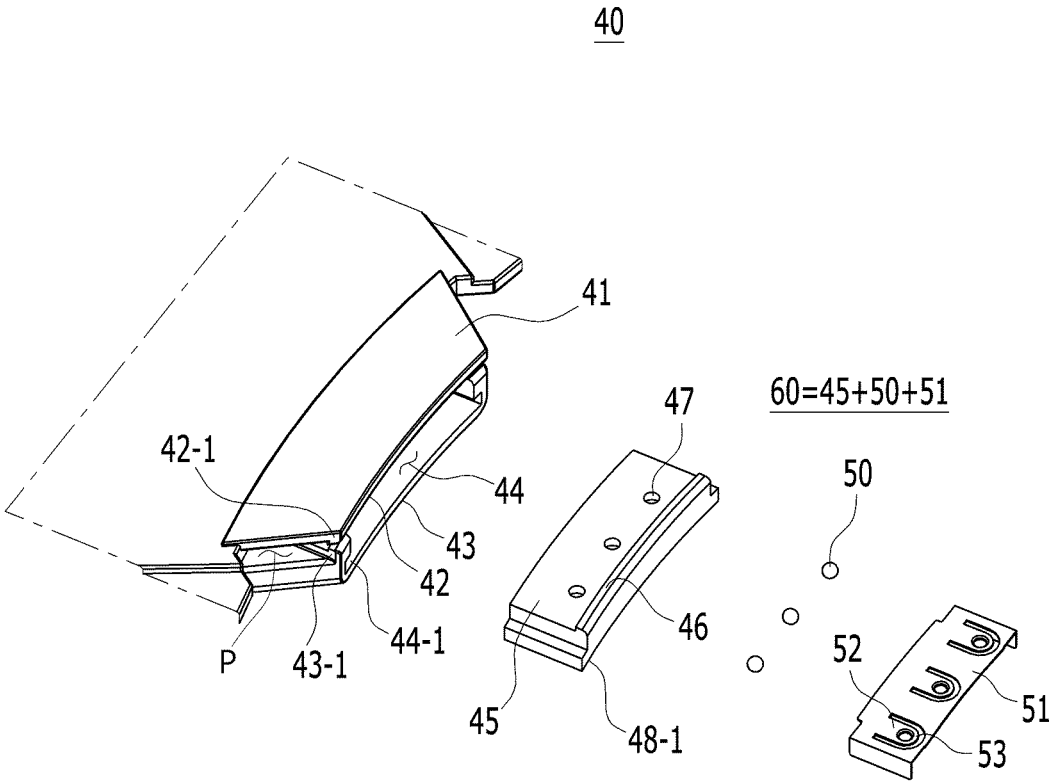
FIG. 4 is an exploded perspective view illustrating a sliding portion according to the present inventive concept.

FIG. 4 is an exploded perspective view illustrating the sliding portion according to the present inventive concept.

The sliding portion 40 is largely divided into a slider housing 41 and a slider 60, and the slider 60 may be subdivided into a slider body 45, the rotating body 50, and a leaf-spring portion 51.

Figure 7:
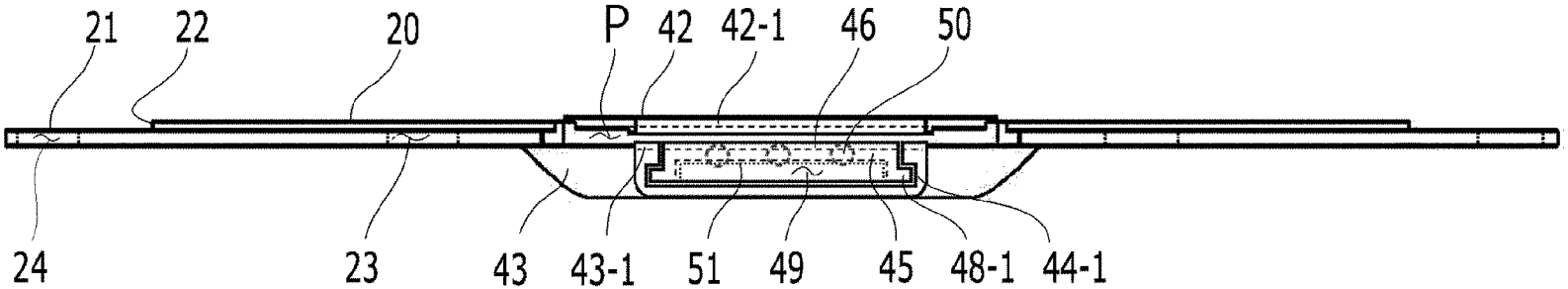
FIG. 7 is a concept view illustrating a sliding portion of a visor according to the present inventive concept when viewed from behind.

The slider housing 41 is integrated with the main visor 2 and is divided into an upper housing body 42 and a lower housing body 43 as shown in FIGS. 4 and 7. A path P is formed between the upper housing body 42 and the lower housing body 43 to allow the guiding surface 12 and the guiding rail 13 of the guiding portion 10 to be inserted thereinto and laterally pass therethrough.

The upper housing body 42 is a part located above the path P and shown on a top surface of the visor 2 when the cap is put on. An upper separation-preventing step 42-1 is formed on a rear end of the upper housing body 42 facing the crown 1 to protrude downward to be lengthwise laterally.

Accordingly, when the guiding rail 13 is inserted laterally into the path P, even when the visor 2 is pulled forward, an upper part of the guiding rail 13 is held by the upper separation-preventing step 42-1 and not easily separated.

The lower housing body 43 is a part located below the path P and shown on a bottom surface of the visor 2 when the cap is put on.

A slider accommodation portion 44 into which the slider 60 is inserted is formed on the lower housing body 43, and a lower separation-preventing step 43-1 by which a lower part of the guiding rail 13 is held is formed on the lower housing body 43 laterally above the slider accommodation portion 44.

The lower separation-preventing step 43-1 performs a function equal to that of the above-described upper separation-preventing step 42-1. That is, when the guiding rail 13 is inserted into the path P, even when the visor 2 is pulled forward, the lower part of the guiding rail 13 is held by the lower separation-preventing step 43-1 and not easily separated.

The slider accommodation portion 44 may be formed to have a shape corresponding to a shape of the slider 60, which is to be inserted thereinto, so as to insert the slider 60 thereinto.

The shape of the slider accommodation portion 44 according to the embodiment of the present inventive concept is a rectangular parallelepiped shape with an upper part opened toward the path P, and slider-coupling grooves 44-1 are further formed in the lower housing body 43 on left and right sides of a lower part thereof.

The shape of the slider accommodation portion 44 is formed according to the shape of the slider 60 according to the embodiment of the present inventive concept which will be described below. The shape of the slider accommodation portion may be changed when the shape of the slider is changed in a design.

Figure 6:
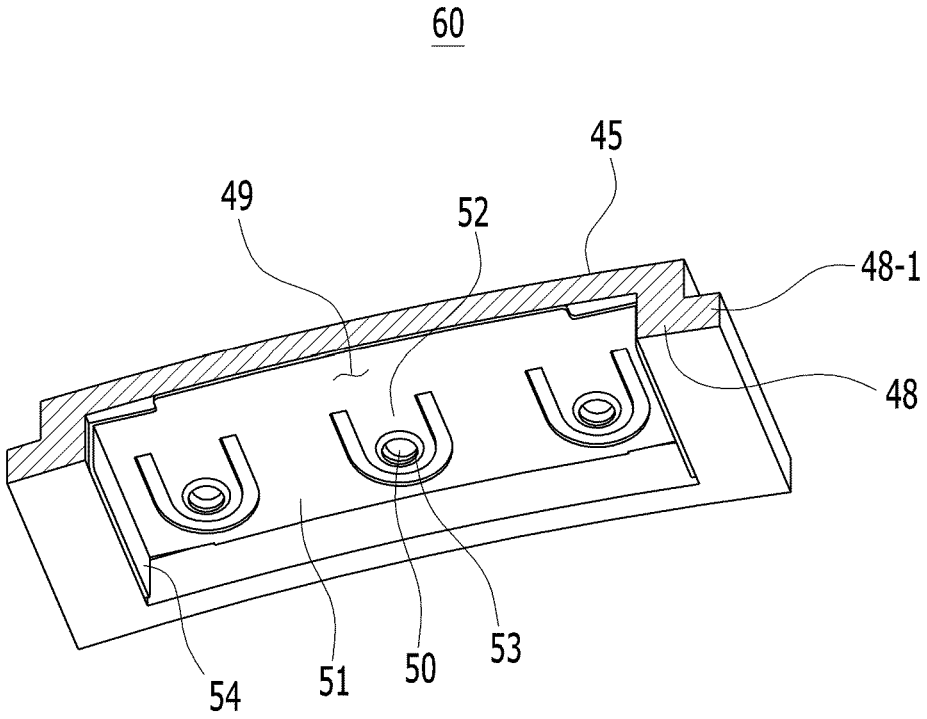
FIG. 6 is a perspective view illustrating a slider according to the present inventive concept when viewed from below.

As shown in FIGS. 4, 6, and 7, the slider 60 according to the embodiment of the present inventive concept includes the slider body 45 having a shape close to a rectangular parallelepiped shape overall, the leaf-spring portion 51 built in the slider body 45, and the rotating body 50 inserted and installed between the slider body 45 and the leaf-spring portion 51.

A rotating body accommodation hole 47 is formed in an upper part of the slider body 45, and a leaf spring portion accommodation space 49 capable of accommodating the leaf-spring portion 51 is formed inside the body below the rotating body accommodation hole 47.

Also, as shown in FIGS. 4 and 7, a protruding step 46 configured to hold and prevent the guiding rail 13 from being separated is formed to be laterally lengthwise on a top surface of the slider body 45.

When the protruding step 46 is configured to be collinearly located with the lower separation-preventing step 43-1 in the same shape while the slider body 45 is inserted into and coupled to the slider accommodation portion 44, lateral movement of the sliding portion 40 may be more smoothly performed along the guiding rail 13.

Accordingly, the protruding step 46 and the lower separation-preventing step 43-1 may be formed to have sectional shapes having the same size. Here, when the slider body 45 is inserted into and coupled to the slider accommodation portion 44, the protruding step 46 and the lower separation-preventing step 43-1 are formed as continuously-formed separation-preventing steps having the same shape and being collinearly located as shown in FIG. 7.

Since both the protruding step 46 and the lower separation-preventing step 43-1 prevent the guiding rail 13 from being separated, any one will be selectively formed as necessary.

Also, as shown in FIGS. 4 and 7, coupling protruding portions 48-1 protruding outward are formed on both outer surfaces of the slider body 45 so as to be inserted into the slider coupling grooves 44-1 of the lower housing body.

The rotating body 50 is accommodated in the rotating body accommodation hole 47 formed in the upper part of the slider body 45 and is placed so as to be freely rotatable in the rotating body accommodation hole.

In the embodiment of the present inventive concept, the rotating body 50 may be a spherical ball and the spherical ball may be replaced with a mechanical element such as a cylindrical roller which is freely rotatable leftward and rightward. The rotating body 50 is formed using a material such as steel or high-intensity plastic to have a smooth surface.

The rotating body accommodation hole 47 is to be opened toward the path P through which the guiding rail 13 passes. The rotating body accommodation hole 47 shown in FIGS. 4 and 7 according to the embodiment of the present inventive concept is formed to pass through the slider body 45 so as to allow an upper part of the rotating body 50 accommodated therein to be partially exposable toward the path P.

That is, a hole diameter of the rotating body accommodation hole 47 shown through the top surface of the slider body 45 shown in FIG. 4 is formed to be smaller than a diameter of the rotating body 50, and a diameter of the rotating body accommodation hole 47 is formed to be increased toward an inside of the slider body 45. For example, the rotating body accommodation hole 47 may be formed to have a conical-shaped hole having a narrow top and a wide bottom.

Accordingly, like a perspective cross section of the sliding portion 40 shown in FIG. 7, a part of the upper part of the rotating body 50 slightly protrudes from the top surface of the slider body 45 and does not completely pass therethrough.

The leaf spring portion accommodation space 49 formed in the body below the rotating body accommodation hole 47 is formed to have a shape corresponding to a shape of the leaf-spring portion 51.

Since the leaf-spring portion 51 according to the embodiment of the present inventive concept has a desk shape including legs on both sides, correspondingly, the leaf spring portion accommodation space 49 has a shape formed by digging into the inside of the slider body 45 in a rectangular parallelepiped shape.

Accordingly, slider body legs 48 are formed on both left and right sides of the leaf spring portion accommodation space 49, and leaf spring legs 54 may be installed to be pressed against insides of the slider body legs 48.

Figure 5:
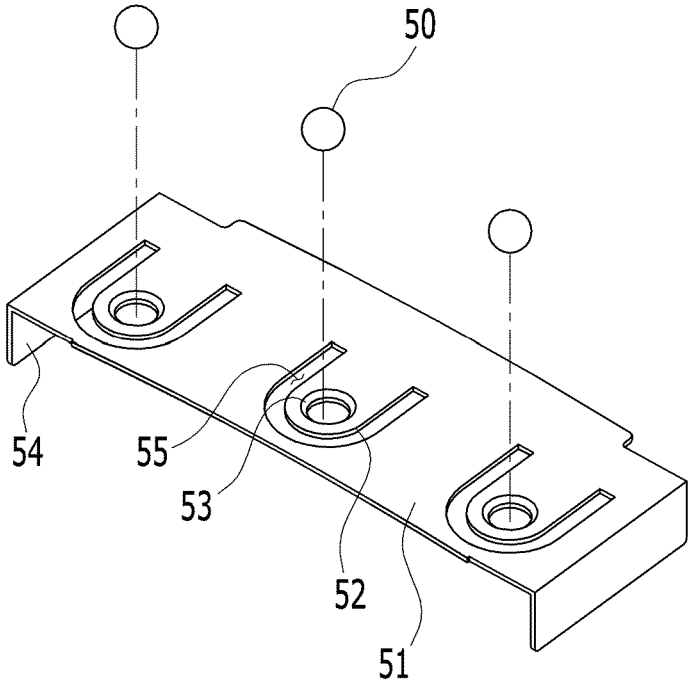
FIG. 5 is a perspective view illustrating a leaf spring according to the present inventive concept.

As shown in FIG. 5, the leaf-spring portion 51 is formed by bending a thin elastic panel such as a steel leaf to have a staple shape, and punched holes 55 having a horseshoe shape are formed in a top surface thereof.

Accordingly, elastic pieces 52 having a protruding part shape are naturally formed inside the punched holes 55, and both side surfaces of the leaf-spring portion 51 formed by bending become the leaf spring legs 54. Since one end of the elastic piece 52 becomes a fixed end, the elastic piece 52 may elastically move in a vertical direction on the basis of the fixed end.

A hole-shaped rotating body mounting portion 53 is formed at a central part of the elastic piece 52 so that the rotating body 50 may be located. Here, a hole diameter of the rotating body mounting portion 53 should be smaller than the diameter of the rotating body 50 to prevent the rotating body from being separated downward. A position of the rotating body mounting portion 53 is formed to coincide with a position of the rotating body accommodation hole 47 of the slider body 45.

Also, the rotating body mounting portion 53 is shown as a complete through-hole shape in FIGS. 5 and 6 but may have a concave groove shape to allow the rotating body 50 to be stably located therein.

FIG. 6 is a perspective view illustrating a state in which the rotating bodies 50 and the leaf-spring portion 51 are coupled to the slider body 45 when viewed from below. A lower part of the rotating body 50 is placed on a top surface of the rotating body mounting portion 53 of the leaf-spring portion 51, and the upper part of the rotating body 50 is accommodated in the rotating body accommodation hole 47 of the slider body 45.

As shown in FIG. 7, the rotating body 50 receives an elastic force of the leaf-spring portion 51 to be pushed upward and partially exposed to a guiding surface 3 above the top surface of the slider body 45 and the path P through which a guiding rail 13 passes so as to come into contact with the guiding surface 3.

In this state, when the guiding portion 10 is inserted into the path P and the visor is laterally rotated, rolling friction occurs between the rotating body 50 and the guiding surface 3 so that rotation of the visor is smoothly performed.

Meanwhile, the rotating body accommodation hole 47 formed in the upper part of the slider body 45 according the present inventive concept is formed in a groove shape opened toward the path P through which the guiding rail 13 passes so as to partially expose the upper part of the rotating body 50 accommodated therein toward the path P.

That is, the rotating body accommodation hole 47 does not have a hole shape passing through the slider body 45 but has a concave groove shape in the top surface of the slider body 45. Accordingly, the leaf spring portion accommodation space 49 and the leaf-spring portion 51 formed inside the slider body are not necessary.

In this case, although components of the slider 60 are simplified, since a great sliding-frictional force occurs between an inner surface of the groove and a surface of the rotating body 50 when the rotating body 50 rotates inside the rotating body accommodation hole having the concave groove shape, rotation is performed less smoothly.

Next, the visor 2 of the embodiment of the present inventive concept will be described with reference to FIGS. 3 and 7 to 10.

The visor 2 according to the embodiment of the present inventive concept includes the main visor 20 and the auxiliary visors 30 coupled to the main visor.

A central part of the main visor 20 includes the sliding portion 40 formed on one end, and left and right side parts become variable surfaces 21 to which the auxiliary visors 30 are coupled.

Since the variable surfaces 21 are formed to have a smaller thickness in comparison to that of the central part of the main visor 20 as shown in FIGS. 1 and 7, movement-restricting steps 22 are formed between the central part and the variable surfaces 21.

A reason for forming the thickness of the variable surfaces 21 to be small is to provide better aesthetics by preventing an overall thickness from being excessively increased when the auxiliary visors 30 are coupled. Accordingly, as necessary, the variable surfaces 21 may be formed not to be thin. Here, the movement-restricting steps 22 may be omitted.

In the embodiment of the present inventive concept, the movement-restricting steps 22 are formed on a top surface of the main visor 20 but may be a bottom surface or top and bottom surfaces of the main visor 20 as necessary.

The auxiliary visors 30 are coupled to the variable surfaces 21 on left and right sides of the main visor 20. For the coupling, as shown in FIGS. 3 and 7, coupling holes 23 for the auxiliary visors 30 are formed on corners of the variable surfaces 21 toward the sliding portion 40. Also, guiding holes 24 having an elongated hole shape are formed in the variable surfaces 21 on left and right sides of the main visor 20 to guide relative movement of the auxiliary visors 30 so as not to deviate from a course. As shown in FIGS. 9 to 13, intermediate guiding protrusions 34-3 formed inside insertion gaps 33 of the auxiliary visors 30 are coupled to the guiding holes 24.

Figure 8:
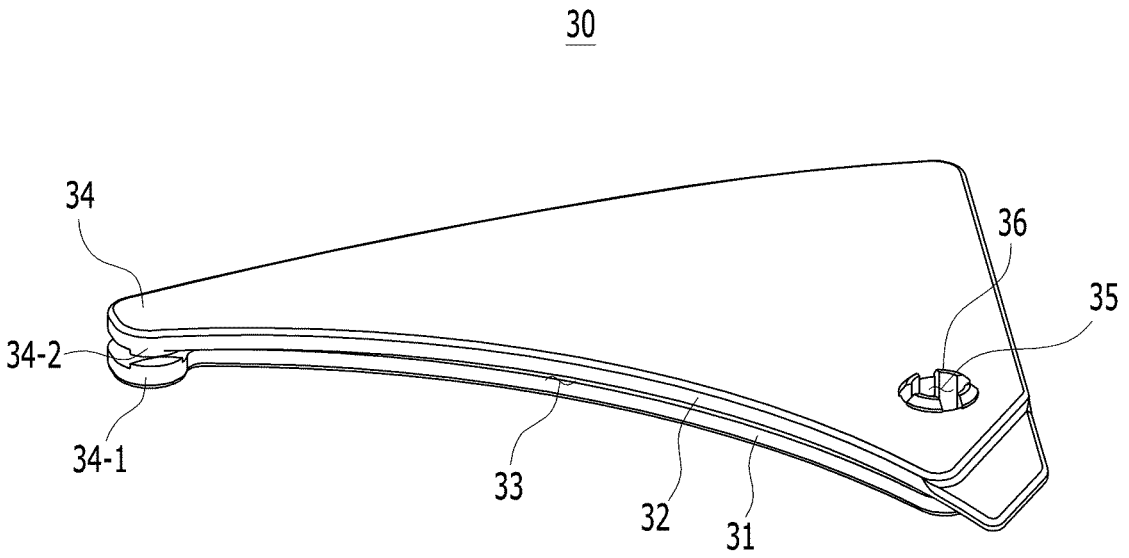
FIG. 8 is a lower perspective view illustrating an auxiliary visor according to the present inventive concept.

FIG. 8 is a perspective view illustrating a bottom surface part of the auxiliary visor 30 which is coupled to each of the variable surfaces 21 on left and right sides of the main visor 20.

The auxiliary visor 30 is divided into an upper auxiliary visor 31 located on the top surface of the main visor 20 and a lower auxiliary visor 32 located on a bottom surface of the main visor 20 when the auxiliary visor 30 is coupled to the main visor 20. When the upper auxiliary visor 31 and the lower auxiliary visor 32 are coupled, an insertion gap 33, into which the variable surface 21 of each of left and right sides of the main visor 20 is inserted to be movable back-and-forth, is formed therebetween.

The auxiliary visor 30 according to the embodiment of the present inventive concept is formed to have a shape similar to a triangle overall. A fastening hole 35 and a fastening protrusion 36 are formed at a corner part of the triangular shape, and the guiding protrusion portion 34 is formed on another corner part.

Also, when the auxiliary visor 30 is coupled to the main visor 20, the corner part at which the fastening hole 35 and the fastening protrusion 36 are formed is coupled to the coupling hole 23 of the main visor 20 to be freely rotatable and the other corner part on which the guiding protrusion portion 34 is formed is coupled to the guiding portion 10 to be freely movable.

Figure 9:
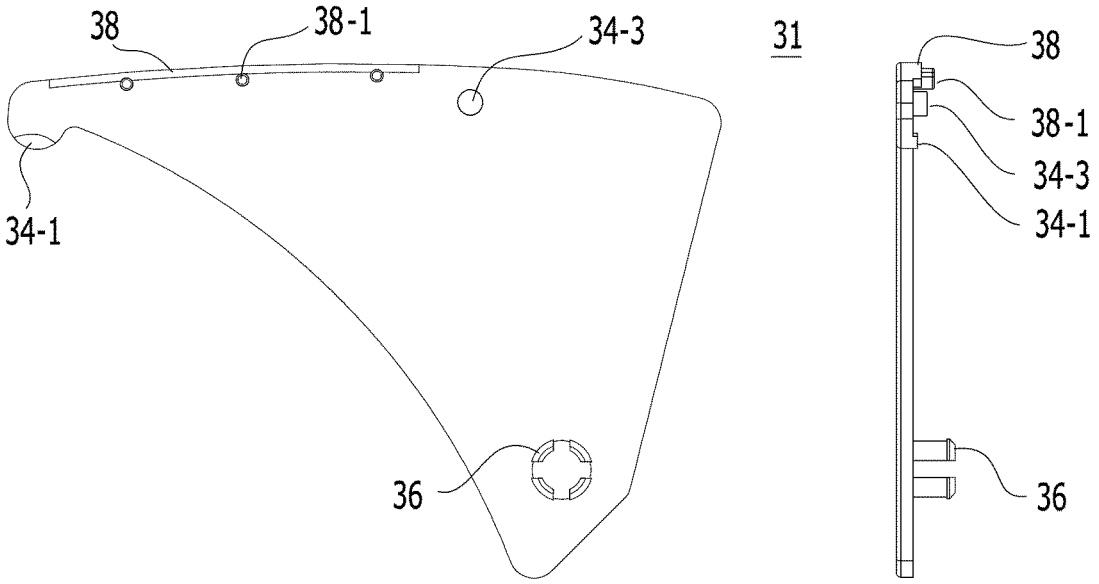
FIG. 9 illustrates an internal plan view and a side view of an upper auxiliary visor according to the present inventive concept.
Figure 10:
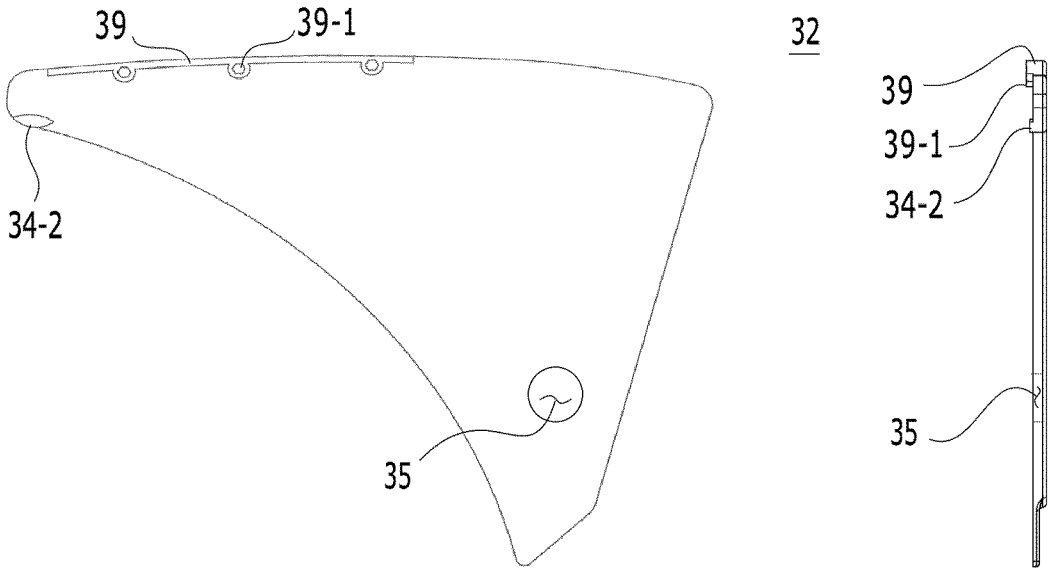
FIG. 10 illustrates an internal plan view and a side view of a lower auxiliary visor according to the present inventive concept.

FIG. 9 illustrates a plan view and a side view of an inner surface of the upper auxiliary visor 31, and FIG. 10 illustrates a plan view and a side view of an inner surface of the lower auxiliary visor 32.

In the embodiment of the present inventive concept, the fastening protrusion 36 is formed on one corner part toward the inner surface of the upper auxiliary visor 31, and the fastening hole 35 is formed in one corner part toward the inner surface of the lower auxiliary visor 32.

Accordingly, when the upper auxiliary visor 31 and the lower auxiliary visor 32 are coupled so that the inner surfaces thereof face each other, the fastening protrusion 36 passes through and is coupled to the fastening hole 35.

On the other hand, the fastening protrusion 36 and the fastening hole 35 may be installed at the lower auxiliary visor 32 and the upper auxiliary visor 31, respectively.

The fastening protrusion 36 according to the embodiment of the present inventive concept is formed by circularly arranging four protruding columns with holding steps outside end parts thereof. When the protruding columns pass through the fastening hole 35, the holding steps are held by an edge of the fastening hole to be fastened.

Accordingly, when the auxiliary visors 30 are coupled to the main visor 20, the fastening protrusions 36 sequentially pass through the coupling holes 23 of the main visor 20 inserted in the insertion gaps 33 and the fastening holes 35 to be fastened thereto.

Meanwhile, the fastening protrusions 36 may be formed to have a simple cylindrical shape without holding steps. In this case, the fastening hole 35 of the lower auxiliary visor 32 may be formed to have a groove shape which does not pass therethrough so that insertion fitting method using an auxiliary visor coupling protrusion 38-1 and an auxiliary visor coupling groove 39-1 may be performed.

As shown in FIG. 8, the guiding protrusion portion 34 according to the embodiment of the present inventive concept includes an upper guiding protrusion 34-1 and a lower guiding protrusion 34-2 formed on one corners of the upper auxiliary visor 31 and the lower auxiliary visor 32, respectively.

As shown in FIGS. 1 and 2, the upper guiding protrusion 34-1 and the lower guiding protrusion 34-2 are installed to be located on a top surface and a bottom surface of the guiding surface 12, respectively, when the auxiliary visor 30 is coupled to the main visor 20. That is, since the guiding rail 13 of the guiding portion 10 is inserted into and held by an inside of the guiding protrusion portion 34 of the auxiliary visor 30, the auxiliary visor 30 is slidably movable without separating from the guiding portion 10 when the visor 2 rotates.

Gap-forming steps 38 and 39 having certain heights are formed on parts of edges of inner surfaces of the upper auxiliary visor 31 and the lower auxiliary visor 32, respectively.

The gap-forming step 38 of the upper auxiliary visor 31 and the gap-forming step 39 of the lower auxiliary visor 32 are installed in positions facing each other. Accordingly, when the upper auxiliary visor 31 and the lower auxiliary visor 32 are coupled, a pair of such gap-forming steps 38 and 39 come into contact with each other and space inner surfaces of the upper auxiliary visor 31 and the lower auxiliary visor 32 to be at a certain height apart from each other. An interval formed as described above becomes the insertion gap 33 into which the variable surface 21 of the main visor 20 is inserted.

In the embodiment of the present inventive concept, a plurality of such auxiliary visor coupling protrusions 38-1 are installed on a periphery of the gap-forming step 38 of the upper auxiliary visor 31, and auxiliary visor coupling grooves 39-1 are installed in the lower auxiliary visor 32 at positions corresponding to those of the auxiliary visor coupling protrusions 38-1.

The auxiliary visor coupling protrusions 38-1 and the auxiliary visor coupling grooves 39-1 may be manufactured to have shapes which are insertion-fitted into each other.

It is necessary to install the auxiliary visor coupling protrusions 38-1, the auxiliary visor coupling grooves 39-1, and the gap-forming steps 38 and 39 in a place limited in not belonging to an area in which the auxiliary visors 30 and the variable surfaces 21 inserted thereinto move relatively.

As shown in FIG. 8, the intermediate guiding protrusions 34-3 are formed inside the insertion gaps 33 of the auxiliary visors 30. The intermediate guiding protrusions 34-3 are formed at positions to be insertable into the guiding holes 24 formed in the variable surfaces 21 of the main visor.

In the embodiment of the present inventive concept, the auxiliary visor coupling protrusions 38-1, the auxiliary visor coupling grooves 39-1, and the gap-forming steps 38 and 39 are installed along outer edges of the auxiliary visors 30 at positions limited to half an overall length from the guiding protrusion portions 34 to the outward edges. Due to a limitation in installation positions, as shown in FIGS. 11 to 13, it is possible to prevent the auxiliary visors 30 and the variable surfaces 21 from mutually interfering with relative movements thereof when the visor 2 rotates.

Figure 11:
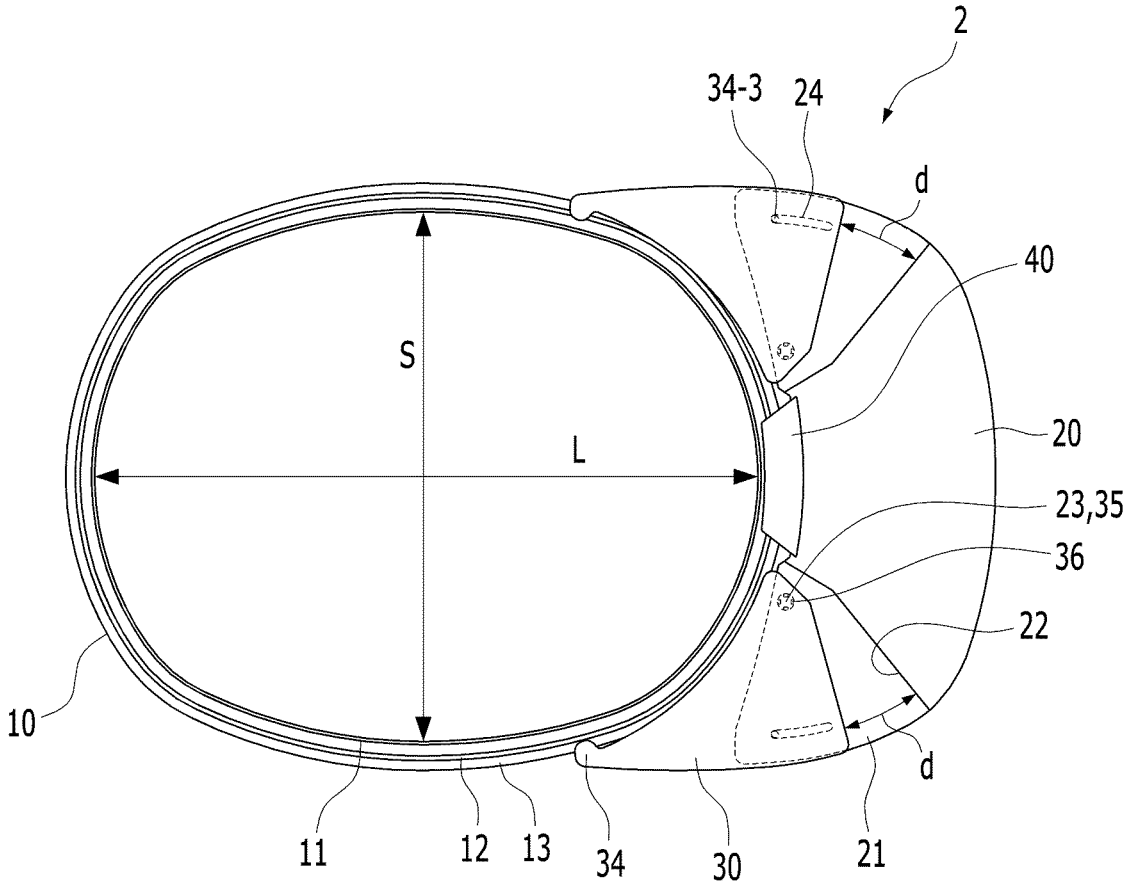
FIG. 11 is a state view illustrating the auxiliary visor when the visor faces forward according to the present inventive concept.
Figure 12:
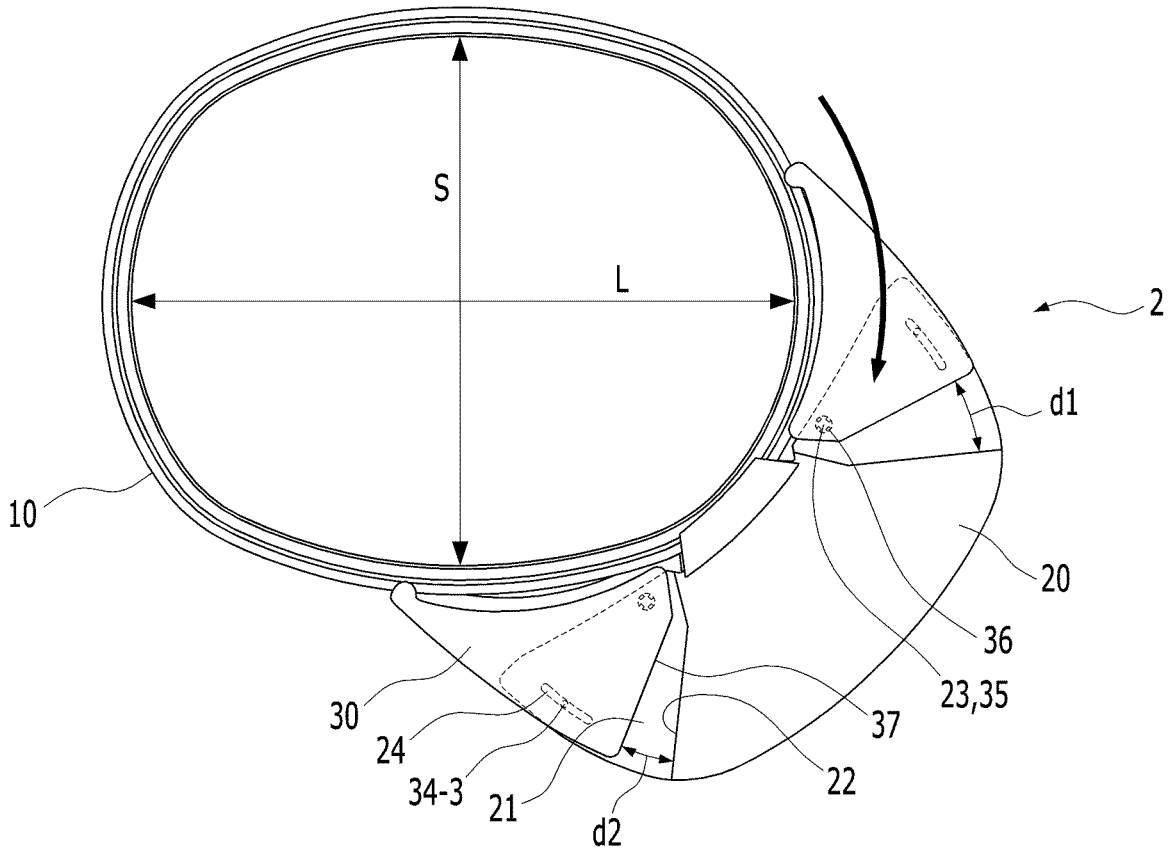
FIG. 12 is a state view illustrating the auxiliary visor when the visor of FIG. 9 rotates by about 45 degrees.
Figure 13:
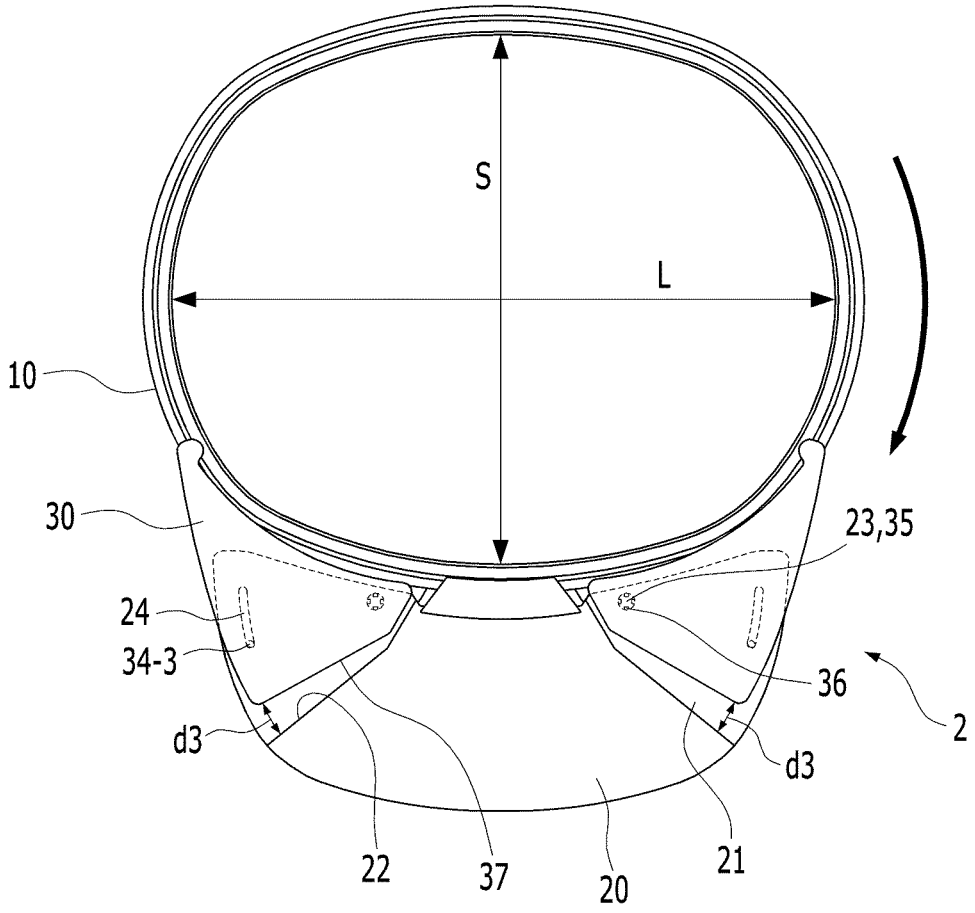
FIG. 13 is a state view illustrating the auxiliary visor when the visor of FIG. 9 rotates by about 90 degrees.

Meanwhile, as shown in FIGS. 11 and 13, the intermediate guiding protrusions 34-3 and the guiding holes 24 are configured so that the intermediate guiding protrusions 34-3 are located at left ends of the guiding holes 24 when the main visor 20 arrives at a position in front of the cap and the intermediate guiding protrusions 34-3 are located at right ends (lower ends in FIG. 13) of the guiding holes 24 when the main visor 20 arrives at a position on a side surface of the cap.

A configuration in which an overall shape of the visor 2 varies according to a curvature of the head circumference when the visor 2 according to the embodiment of the present inventive concept is rotated will be described with reference to FIGS. 11 to 13. Directional terms such as "front surface," "right side," "left side," and the like used in a description with reference to FIGS. 11 to 13 are based on a user who wears the cap.

FIG. 11 illustrates a state in which the visor 2 is coupled to the guiding portion 10 of the crown 1 to face forward while a pair of such auxiliary visors 30 installed on left and right sides of the main visor 20 are coupled. Here, the pair of auxiliary visors 30 are equally spaced at a basic distance d apart from the movement-restricting steps 22 of the main visor 20. Also, the intermediate guiding protrusion 34-3 of the auxiliary visor 30 is located almost at an end of the guiding hole 24 farthest from the movement-restricting step 22 (however, it may be designed to form a slight distance from the end in consideration of an error caused by the head shape when the cap is worn).

However, a distance between the auxiliary visor 30 and the movement-restricting step 22 varies according to a curvature formed by the guiding portion 10 between the sliding portion 40 and the guiding protrusion portion 34. That is, when the curvature of the guiding portion 10 is great, the distance decreases. When the curvature is small, the distance increases.

As shown in FIG. 11, generally, when the visor 2 faces a front of the cap, the curvature formed by the guiding portion 10 between the sliding portion 40 and the guiding protrusion portion 34 is smallest. Accordingly, in the embodiment of the present inventive concept, the basic distance d is the greatest distance but may be designed to be changed according to a shape of a cap to be manufactured.

FIG. 12 illustrates a state in which the visor 2 is rotated rightward about 40 degrees along the guiding portion 10.

Here, a curvature formed by the guiding portion 10 between the sliding portion 40 and the guiding protrusion portion 34 of the auxiliary visor on a right side is greater than a curvature formed by the guiding portion 10 between the sliding portion 40 and the guiding protrusion portion 34 of the auxiliary visor on a left side.

Accordingly, a distance d2 between the movement-restricting step 22 and an auxiliary visor side surface 37 of the auxiliary visor on the right side becomes smaller than a distance d1 between the movement-restricting step 22 and an auxiliary visor side surface 37 of the auxiliary visor on the left side.

Here, the intermediate guiding protrusion 34-3 of the left auxiliary visor 30 slightly moves from an end of the guiding hole 24 shown in FIG. 11 toward the movement-restricting step 22 along the hole. Also, the intermediate guiding protrusion 34-3 of the right auxiliary visor 30 slightly moves from the guiding hole 24 toward the movement-restricting step 22 further than the intermediate guiding protrusion 34-3 of the left auxiliary visor 30.

FIG. 13 illustrates a state in which the visor 2 is rotated rightward about 90 degrees along the guiding portion 10.

Here, curvatures formed by the sliding portion 40 and the guiding portion 10 between the auxiliary visor guiding protrusion portions 34 on both sides are equal. Also, the curvature of the guiding portion 10 at this position is the greatest among the curvatures of the guiding portion 10 of the whole cap.

Accordingly, distances between the movement-restricting steps 22 and both the auxiliary visors 30 are equally formed to be a minimum distance d3.

Also, here, the intermediate guiding protrusion 34-3 of each of both of the auxiliary visors 30 moves toward the end of the guiding hole 24 closest to the movement-restricting step 22.

However, although the guiding rail 13 of the guiding portion 10 is inserted into and held by the inside of the guiding protrusion portion 34 of the auxiliary visor 30 to allow the auxiliary visor 30 to be slidably movable without separating from the guiding portion 10, a height of the guiding rail 13 is low such that there is a possibility of the guiding protrusion portion 34 being separated from the guiding rail 13 while the visor 2 is rotated along the guiding portion 10.

To prevent this, in the embodiment of the present inventive concept, the main visor 20 and an outside of the variable surface 21 are coupled using the intermediate guiding protrusion 34-3 of the auxiliary visor 30 and the main visor 20 and an inside of the variable surface 21 are coupled using the coupling protrusion 35. Since the above-described coupling configuration supports the triangular-shaped auxiliary visor 30 on both sides with a certain distance therebetween, a phenomenon in which the guiding protrusion portion 34 of the auxiliary visor 30 is separated and is taken off of the guiding rail 13 does not occur during a visor rotation process of FIGS. 11 to 13.

Meanwhile, since a shape of the guiding portion 10 varies according to the head shape of a person when the person wears the cap according to the embodiment of the present inventive concept, the curvature formed by the guiding portion 10 may be formed to be different from a curvature formed by the elliptical-shaped guiding portion 10 shown in FIGS. 11 to 13.

However, according to the present inventive concept, no matter what the curvature of the guiding portion 10 is changed to, the auxiliary visor 30 moves along the guiding portion 10 while automatically changing a distance from the movement-restricting step 22 according to the changed curvature. Accordingly, the visor 2 of the cap according to the present inventive concept smoothly rotates along the guiding portion 10 regardless of head shapes of people.

The embodiment of the present inventive concept which has been described above and illustrated in the drawings should not be construed as limiting the technical scope of the present inventive concept. The scope of the present inventive concept should be recognized only by the content disclosed in the claims, and a variety of modifications and changes of the technical concept of the present inventive concept may be made by one of ordinary skill in the art. Accordingly, the modifications and changes are included in the scope of the present inventive concept when they are obvious to one of ordinary skill in the art.

The invention claimed is:

1. A cap with a position-variable visor, the cap comprising a crown (1) comprising a guiding portion (10) on an edge of a bottom end and a visor (2) comprising a sliding portion (40) coupled to the guiding portion (10), wherein the guiding portion (10) comprises a guiding surface (12) formed to extend outward from the cap and a guiding rail (13) formed by increasing a thickness of an end of the guiding surface, wherein the sliding portion (40) comprises a slider (60) and a slider housing (41) into which the slider (60) is inserted, wherein in the slider (60), a rotating body accommodation hole (47) is formed in a slider body (45), wherein a rotating body (50) is inserted into the rotating body accommodation hole (47) to be freely rotatable while a part of the inserted rotating body (50) is exposed toward the guiding rail (13), wherein the slider housing (41) is divided into an upper housing body (42) and a lower housing body (43) with a path (P) therebetween through which the guiding surface (12) and the guiding rail (13) pass laterally, wherein the upper housing body (42) is located above the path (P) and includes an upper separation-preventing step (42-1) by which an upper part of the guiding rail (13) is held, and wherein the lower housing body (43) is located below the path (P) and includes a slider accommodation portion (44) into which the slider (60) is inserted.

2. The cap of claim 1, wherein a leaf spring accommodation portion (49) is formed in the slider body (45) below the rotating body accommodation hole (47), wherein the leaf spring accommodation portion (49) accommodates a leaf-spring portion (51), wherein an elastic piece (52) comprising a rotating body mounting portion (53) is formed on the leaf-spring portion (51), and wherein a lower part of the rotating body (50) inserted in the rotating body accommodation hole (47) is configured to be mounted in the rotating body mounting portion (53).

3. The cap of claim 1, wherein a protruding step (46), by which the guiding rail (13) is held not to be separated therefrom, is formed on a top surface of the slider body (45).

4. The cap of claim 1, wherein the lower housing body (43) located below the path (P) includes a lower separation-preventing step (43-1) by which a lower part of the guiding rail (13) is held.

5. The cap of claim 1, wherein a coupling protruding portion (48-1) protruding outward is formed on an outer surface of the slider body (45), wherein a slider coupling groove (44-1) is formed in an inner sidewall of the slider housing (41), and wherein the coupling protruding portion (48-1) is inserted into the slider coupling groove (44-1) so that the slider (60) is coupled to the slider housing.

6. A cap with a position-variable visor, the cap comprising a crown (1) comprising a guiding portion (10) formed on an edge of a bottom end and a visor (2) including a sliding portion (40) coupled to the guiding portion (10) to move along the guiding portion (10), wherein the visor (2) comprises a main visor (20) having one end on which the sliding portion (40) is formed and an auxiliary visor (30) having one corner part coupled to the main visor (20) to be freely rotatable and another corner part coupled to the guiding portion (10) to be freely movable, wherein the auxiliary visor (30) is formed by vertically coupling an upper auxiliary visor (31) located on a top surface of the main visor (20) to a lower auxiliary visor (32) located on a bottom surface of the main visor (20), and wherein an insertion gap (33) into which a part of the main visor (20) is inserted is formed between the upper auxiliary visor (31) and the lower auxiliary visor (32) which are coupled to each other.

7. The cap of claim 6, wherein the main visor (20) includes a coupling hole (23) formed therein, wherein the auxiliary visor (30) includes a fastening hole (35) formed in any one of the upper auxiliary visor (31) and the lower auxiliary visor (32) and a fastening protrusion (36) formed in another one of the upper auxiliary visor and the lower auxiliary visor at a position corresponding to the fastening hole (35), and wherein the fastening protrusion (36) passes through the coupling hole (23) of the main visor (20) inserted into the insertion gap (33) and is fastened to the fastening hole (35).

8. The cap of claim 6, wherein the main visor (20) includes a guiding hole (24) having an elongated hole shape and configured to guide the auxiliary visor (30) not to be separated from a course, and wherein the auxiliary visor (30) includes an intermediate guiding protrusion (34-3) inserted into the guiding hole (24) to be formed inside the insertion gap (33) while the auxiliary visor (3) moves relatively to the main visor (20).

9. The cap of claim 6, wherein the guiding portion (10) comprises a guiding surface (12) formed to extend outward from the cap and a guiding rail (13) formed by increasing a thickness of an end of the guiding surface (12), and wherein the guiding portion (10) and the auxiliary visor (30) are coupled by the guiding rail (13) of the guiding portion (10) being inserted into and then held by a guiding protrusion portion (34) of the auxiliary visor (30).

* * * * *